US011598101B2

(12) United States Patent
Barram

(10) Patent No.: US 11,598,101 B2
(45) Date of Patent: Mar. 7, 2023

(54) VEHICLE SERVICE PIT

(71) Applicant: New Century Buildings L.L.C., Portland, OR (US)

(72) Inventor: Peter J. Barram, Lake Oswego, OR (US)

(73) Assignee: New Century Buildings L.L.C., Portland, OR (US)

( * ) Notice: Subject to any disclaimer, the term of this patent is extended or adjusted under 35 U.S.C. 154(b) by 263 days.

(21) Appl. No.: 16/712,932

(22) Filed: Dec. 12, 2019

(65) Prior Publication Data

US 2020/0190813 A1 Jun. 18, 2020

Related U.S. Application Data

(60) Provisional application No. 62/780,836, filed on Dec. 17, 2018.

(51) Int. Cl.

| | |
|---|---|
| ***E04F 11/04*** | (2006.01) |
| ***E04H 5/06*** | (2006.01) |
| ***E04F 11/06*** | (2006.01) |
| *E06C 1/393* | (2006.01) |

(52) U.S. Cl.

CPC ..... *E04F 11/04* (2013.01); *E04F 11/06* (2013.01); *E04F 11/062* (2013.01); *E04H 5/06* (2013.01); *E06C 1/393* (2013.01)

(58) Field of Classification Search

CPC ..... E04F 11/062; E04F 11/04; E04F 11/064; E04F 11/066; E04F 11/06; E04H 5/06; E06C 1/39; E06C 1/393; E06C 9/08; E04B 1/6112; E04B 2001/6195

See application file for complete search history.

(56) References Cited

U.S. PATENT DOCUMENTS

| | | | | |
|---|---|---|---|---|
| 172,830 A * | 2/1876 | Stewart et al. | ..... | E04F 11/064 182/98 |
| 1,654,073 A * | 12/1927 | Fagan | ..... | B60S 5/00 137/236.1 |
| 2,160,225 A * | 5/1939 | Newman | ..... | E04B 2/62 52/742.16 |

(Continued)

FOREIGN PATENT DOCUMENTS

| | | | | |
|---|---|---|---|---|
| DE | 29706219 U1 * | 5/1997 | ..... | E04G 1/15 |
| FR | 2404083 A1 * | 4/1979 | ..... | E04G 1/15 |

(Continued)

OTHER PUBLICATIONS

Machine Translation of French Patent 2404083 A1 obtained by the European Patent Office at https://worldwide.espacenet.com/ (last accessed Nov. 2, 2022) (Year: 1979).*

(Continued)

*Primary Examiner* — Brian D Mattei
*Assistant Examiner* — Charissa Ahmad
(74) *Attorney, Agent, or Firm* — Stoel Rives LLP

(57) ABSTRACT

The disclosure relates to a service pit having a head section and a foot section made from fiberglass, aluminum or other metal sheeting, molded plastic, or other suitable material. In one example embodiment, the service pit is equipped with a staircase pivotally mounted at one end of the service pit to accommodate a pivoting action of the staircase and permit access to the bottom of the pit for cleaning, maintenance or other operation.

15 Claims, 10 Drawing Sheets

(56) References Cited

U.S. PATENT DOCUMENTS

| | | | | |
|---|---|---|---|---|
| 2,593,336 | A * | 4/1952 | Nixon | E04F 11/06 182/78 |
| 3,127,639 | A * | 4/1964 | Hammitt | E04B 1/62 52/204.591 |
| 3,359,700 | A * | 12/1967 | Birum, Jr. | E04B 1/6112 52/459 |
| 3,394,526 | A * | 7/1968 | Engelbrecht | E04B 1/6112 52/772 |
| 3,603,046 | A * | 9/1971 | Humphrey, Jr. | E04H 5/06 52/173.1 |
| 4,070,805 | A * | 1/1978 | Kastner | E04H 3/14 52/270 |
| 4,158,938 | A * | 6/1979 | Meechan | E04B 1/12 52/584.1 |
| 5,590,739 | A * | 1/1997 | High | E06C 1/397 182/208 |
| 6,161,345 | A * | 12/2000 | Hope | E04H 9/06 49/228 |
| 6,189,653 | B1 * | 2/2001 | Laug | E06C 1/39 182/152 |
| 6,539,678 | B1 | 4/2003 | Campbell et al. | |
| 6,543,579 | B2 * | 4/2003 | Laug | E04G 1/30 182/115 |
| 7,428,800 | B1 * | 9/2008 | Vaughn | E04H 9/12 52/169.9 |
| 8,646,226 | B2 | 2/2014 | Barram | |
| 8,756,869 | B1 * | 6/2014 | Routt | E05C 1/10 49/33 |
| 10,053,884 | B1 | 8/2018 | Shinn | |
| 10,100,576 | B1 * | 10/2018 | Dimovski | E04F 11/062 |
| 2002/0139612 | A1 * | 10/2002 | Laug | E04G 1/30 182/27 |
| 2010/0192487 | A1 * | 8/2010 | Thornton | E04F 11/064 52/741.2 |
| 2019/0376309 | A1 * | 12/2019 | Montesalvo | E04H 15/56 |
| 2021/0010271 | A1 * | 1/2021 | Burger | B64D 11/00 |

FOREIGN PATENT DOCUMENTS

| | | | | |
|---|---|---|---|---|
| FR | 2574842 | A1 * | 6/1986 | |
| WO | WO-9845567 | A1 * | 10/1998 | E06C 1/39 |

OTHER PUBLICATIONS

Brochure: Integrated Lube Services, Inc "EnviroLube Automotive Service Bay System", publicly available at least as of the earliest effective filing date of the pending application, downloaded Apr. 2020 from https://integratedlubeservices.com/brochures/EnviroLube_Automotive_Brochure.pdf (8 pages).

Brochure: Integrated Lube Services, Inc "EnviroLube HD Series Service Bay System", publicly available at least as of the earliest effective filing date of the pending application, downloaded Apr. 2020 from https://integratedlubeservices.com/brochures/EnviroLube_Heavy_Duty_Brochure.pdf (7 pages).

Brochure: Integrated Services, Inc. "Modulube Quick Service Solution" (2018), downloaded Sep. 2018 from https://www.ints.com/products/modulube (36 pages).

* cited by examiner

VEHICLE SERVICE PIT

RELATED APPLICATION DATA

This application is a nonprovisional of and claims the benefit under 35 U.S.C. § 119(e) of U.S. Provisional Patent Application No. 62/780,836, filed Dec. 17, 2018, the disclosure of which is incorporated by reference herein in its entirety.

BACKGROUND

The field of the present disclosure relates to vehicle service pits, and to certain functional features for such vehicle service pits. Generally, vehicle service pits may be included in service stations, oil change facilities, and similar buildings where frequent access to the underside of a vehicle is desired. In many conventional designs, service pits are located in the ground (that is, below a building's grade level) to permit a service technician either to stand up or to lie on a movable glider to access the underside of a vehicle.

These service pits are intended to contain spills and prevent liquids from passing out of the pit, through the walls, and into the ground. The present inventor has recognized that it is desirable for the pit components to be easily movable to allow cleaning of the pit and facilitate removal of spilled liquids. The present inventor has recognized several disadvantages with current service pits. One such disadvantage that occurs with deep service pits is the requirement of a ladder to allow access down into the pit, these ladders being bulky and difficult to move around. The present inventor has recognized a need for a service pit that overcomes some or all of the above-identified disadvantages.

SUMMARY

An example embodiment of a service pit includes a head section and a foot section each made from fiberglass, aluminum or other metal sheeting, molded plastic, or other suitable material. In one example embodiment, the service pit is equipped with a staircase pivotally mounted at one end of the service pit to permit the staircase to be pivoted up and out of the service pit. This pivoting action facilitates access to the bottom of the service pit below the staircase for cleaning, maintenance or other operation.

Additional aspects and advantages will be apparent from the following detailed description of preferred embodiments, which proceeds with reference to the accompanying drawings.

DETAILED DESCRIPTION OF EXAMPLE EMBODIMENTS

Figure 1:
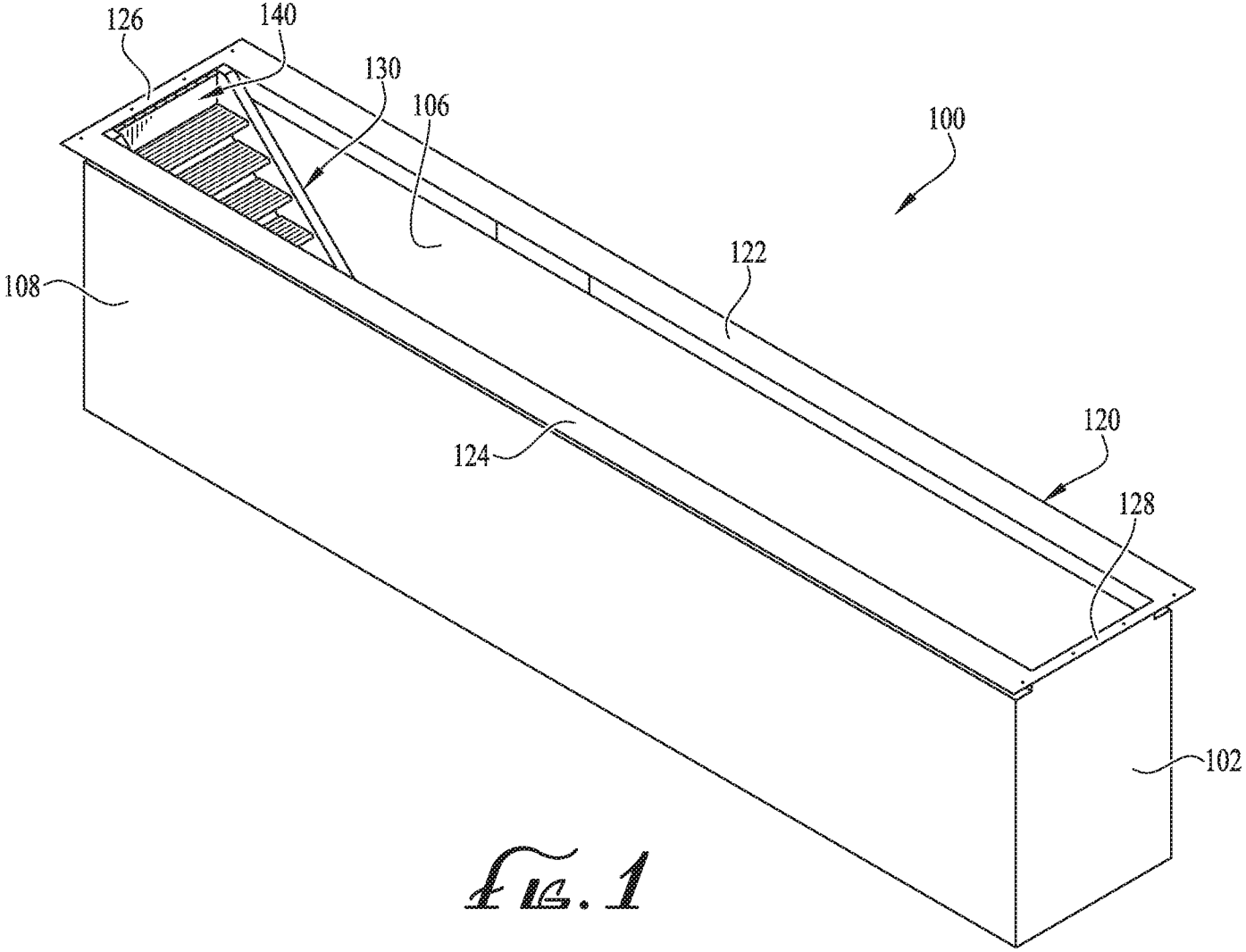
FIG. 1 is a top isometric view of a vehicle service pit in accordance with an example embodiment.

Certain embodiments of service pits are described below and include service pits constructed with a staircase for allowing access down into the service pit. Other embodiments are directed to the operation and use of such service pits. The following description describes certain examples and embodiments but is not meant to limit the scope of the claimed subject matter to the embodiments illustrated and described.

FIGS. 1-4 collectively illustrate a service pit 100 formed in an open top box-shaped structure comprising first and second side walls 106, 108, front or head side wall 102, rear or foot side wall 104, and floor or bottom wall 110. The service pit 100 may optionally include a top/upper peripheral rim 120 disposed around and connected to the side walls 102, 104, 106, 108 along the upper circumference of the top opening of the pit 100. The top rim 120 includes first and second rim sections 122, 124, front rim section 128 and rear rim section 126. The top rim 120 may be level with the ground top surface 10 or may instead extend over the ground top surface 10 when the vehicle service pit 100 is installed.

The service pit 100 may be constructed as a one-piece, or unitary, construction. For example, the service pit 100 may be constructed from poured concrete, either directly in the ground 5 or in a form to create a concrete liner that is placed in the ground 5. In one embodiment, the service pit 100 may be manufactured from fiberglass (or alternately steel or molded plastic) that is placed in the ground 5 to form the service pit structure. In some embodiments, the service pit 100 may be made in multiple pieces that are assembled on-site.

In one example construction for the service pit 100, the side walls 102, 104, 106, 108 and bottom floor or bottom wall 110 may be constructed from fiberglass and the top rim 120 constructed from steel. The service pit 100 may be formed with a sufficient depth to allow a service technician to stand upright in the pit 100 under a vehicle and comfortably work on the vehicle underside. In order to provide easy access down into the service pit 100, a staircase 130 is provided at the rear end of the service pit 100. The example staircase 130 is shown constructed with nine stairs 136 disposed between rails 132, 134. In other embodiments, the staircase 130 may have more or fewer stairs depending on the depth of the service pit 100.

Figure 2:
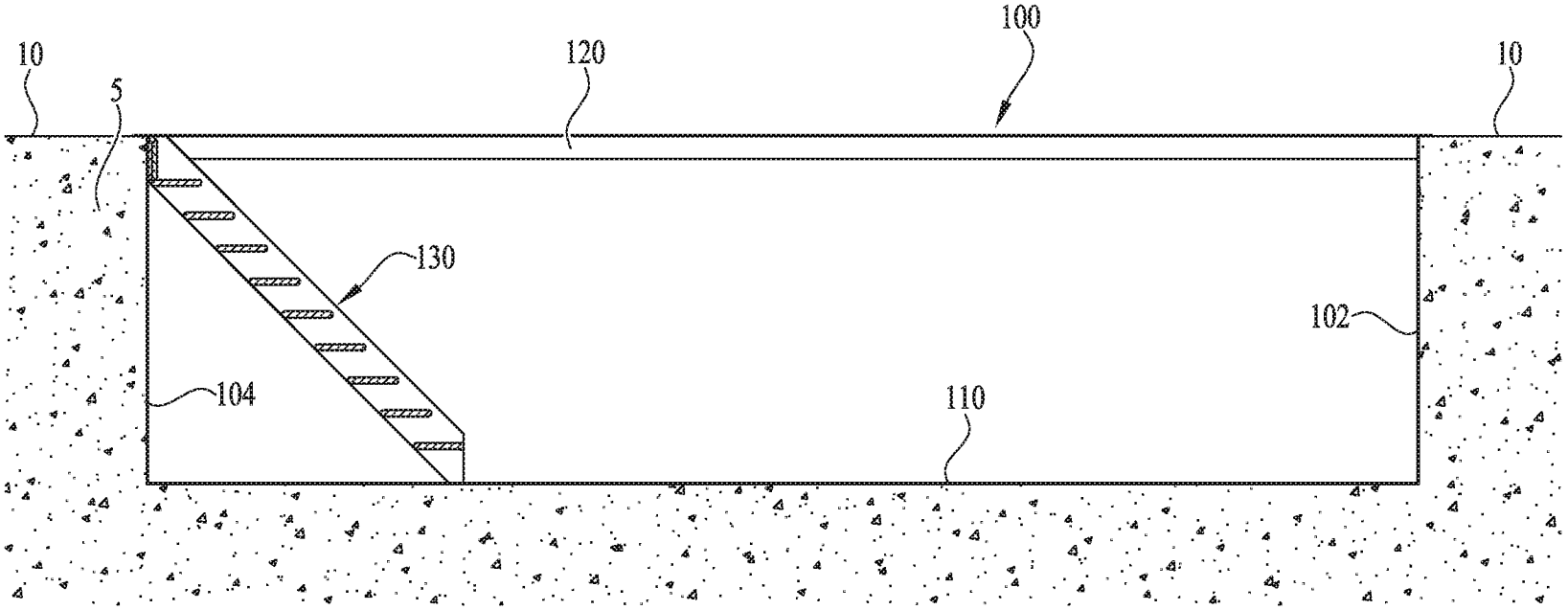
FIG. 2 is a side elevation view of the service pit of FIG. 1 but shown installed in the ground.
Figure 3:
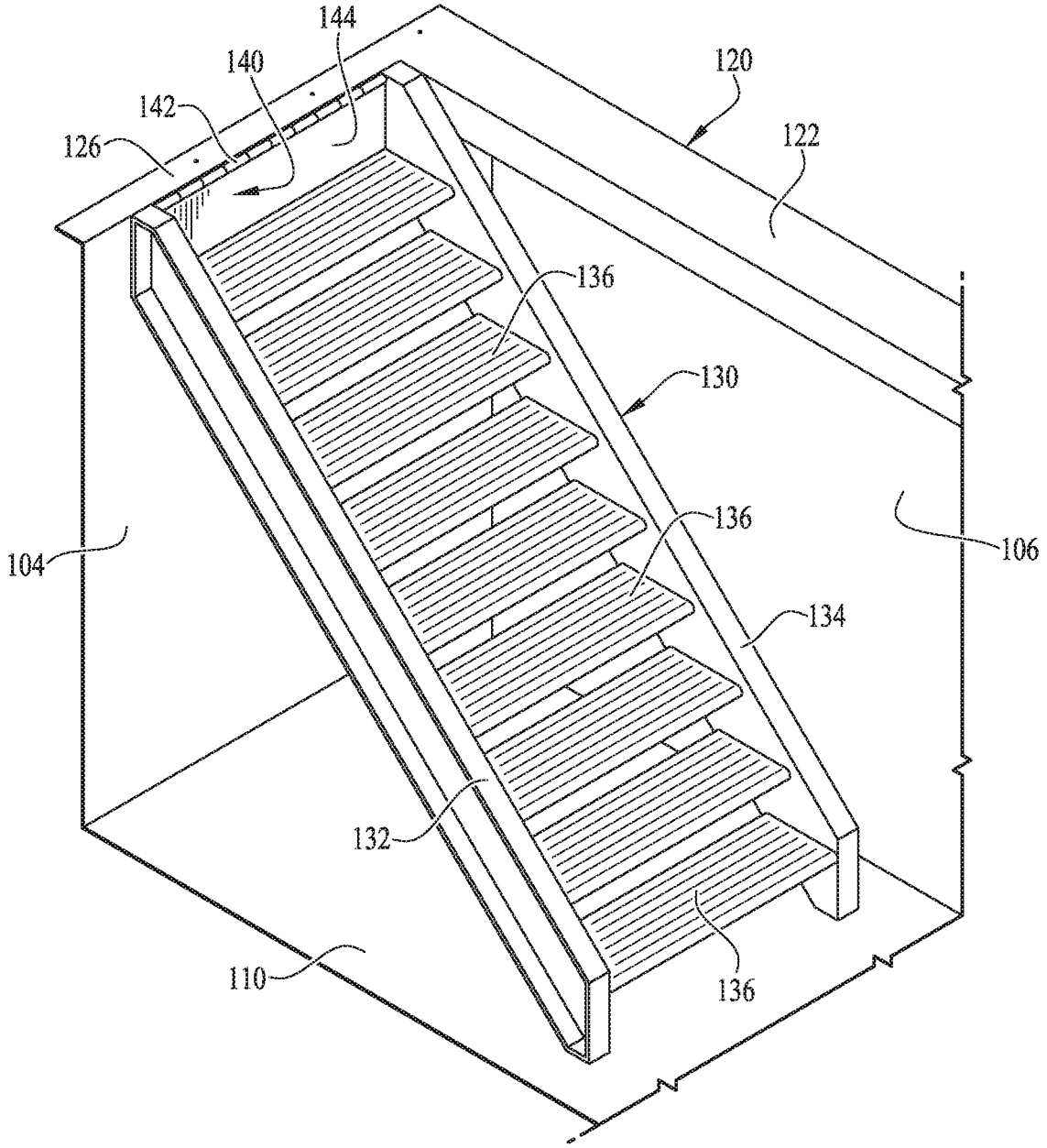
FIG. 3 is a top front isometric view of a portion of the service pit of FIG. 1 illustrating a staircase in a lowered position.
Figure 4:
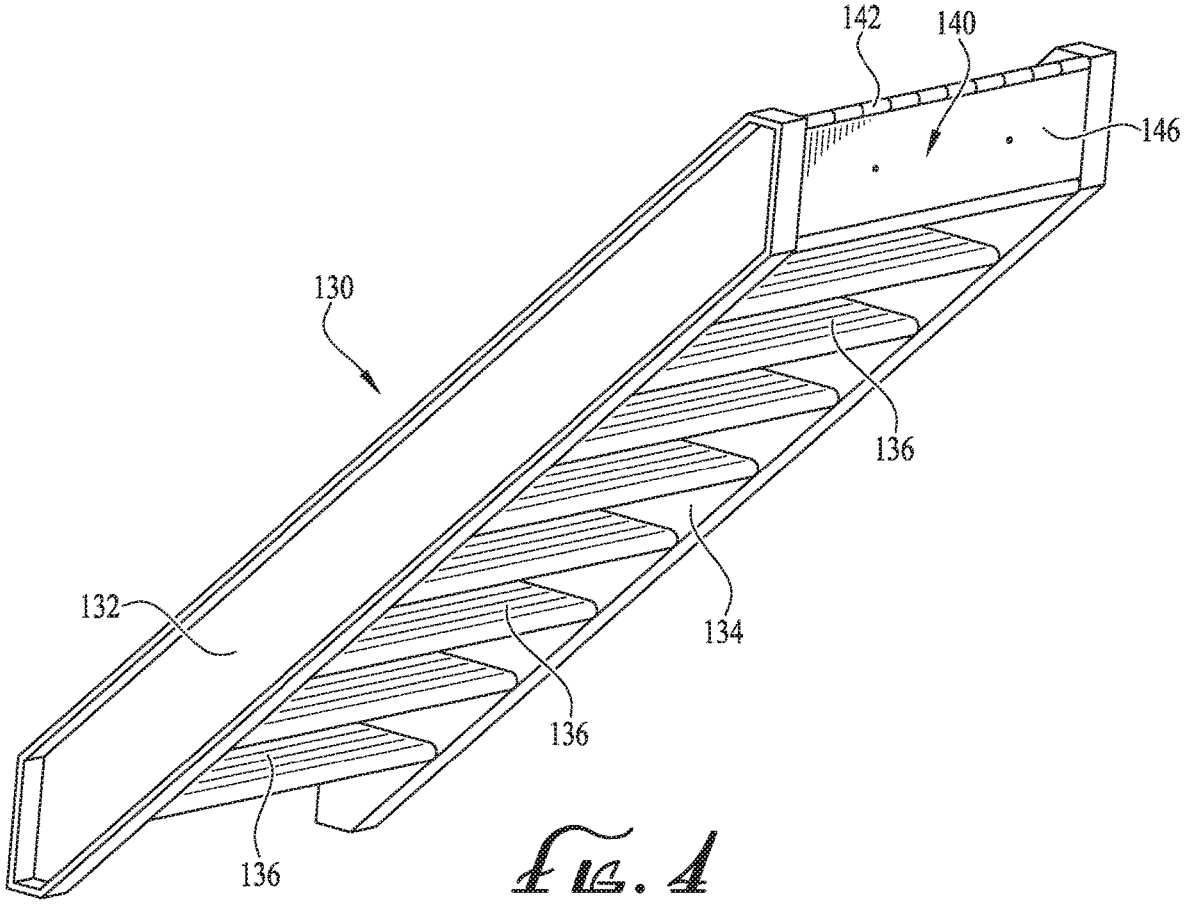
FIG. 4 is a bottom rear isometric view of the staircase of the service pit of FIGS. 1-3.
Figure 5:
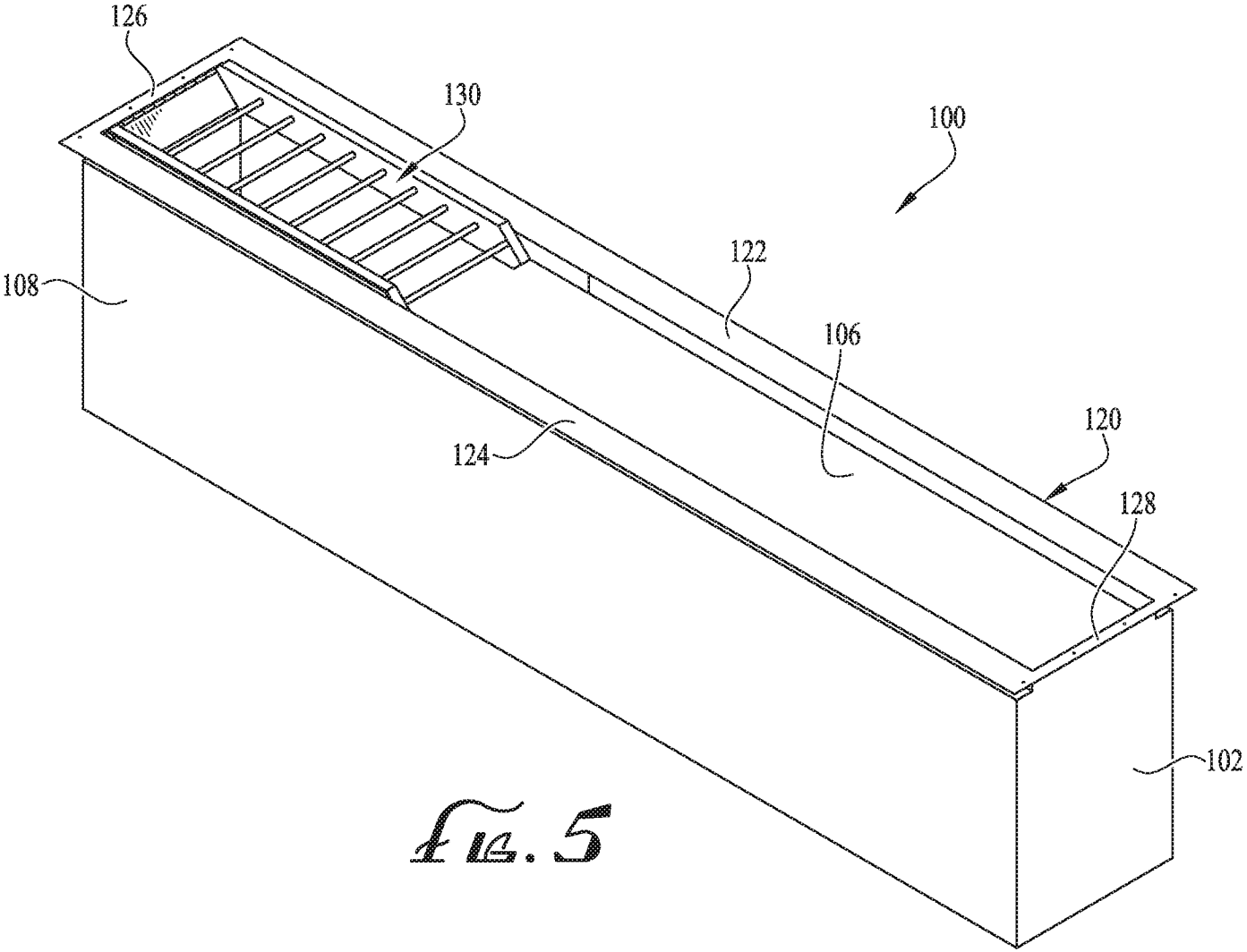
FIG. 5 is a top isometric view of the service pit of FIG. 1 with the staircase in a raised position.

Turning to FIG. 3, the staircase 130 is pivotally mounted at one end of the service pit 100 via a hinge assembly 140 to permit the staircase 130 to be pivoted up from a lowered position (as shown in FIGS. 1-3) to a raised position (as shown in FIG. 5). The pivoting action accommodates access to the bottom of the service pit 100 below the staircase 130 for cleaning, maintenance or other operation. In one embodiment, the hinge assembly 140 is comprised of a hinge front plate 144 (see FIG. 3) connected to the top of the first and second rails 132, 134, a rear plate 146 (see FIG. 4) connected to an upper portion of the rear side wall 104, and a hinge section 142 for accommodating the pivoting action.

Figure 6:
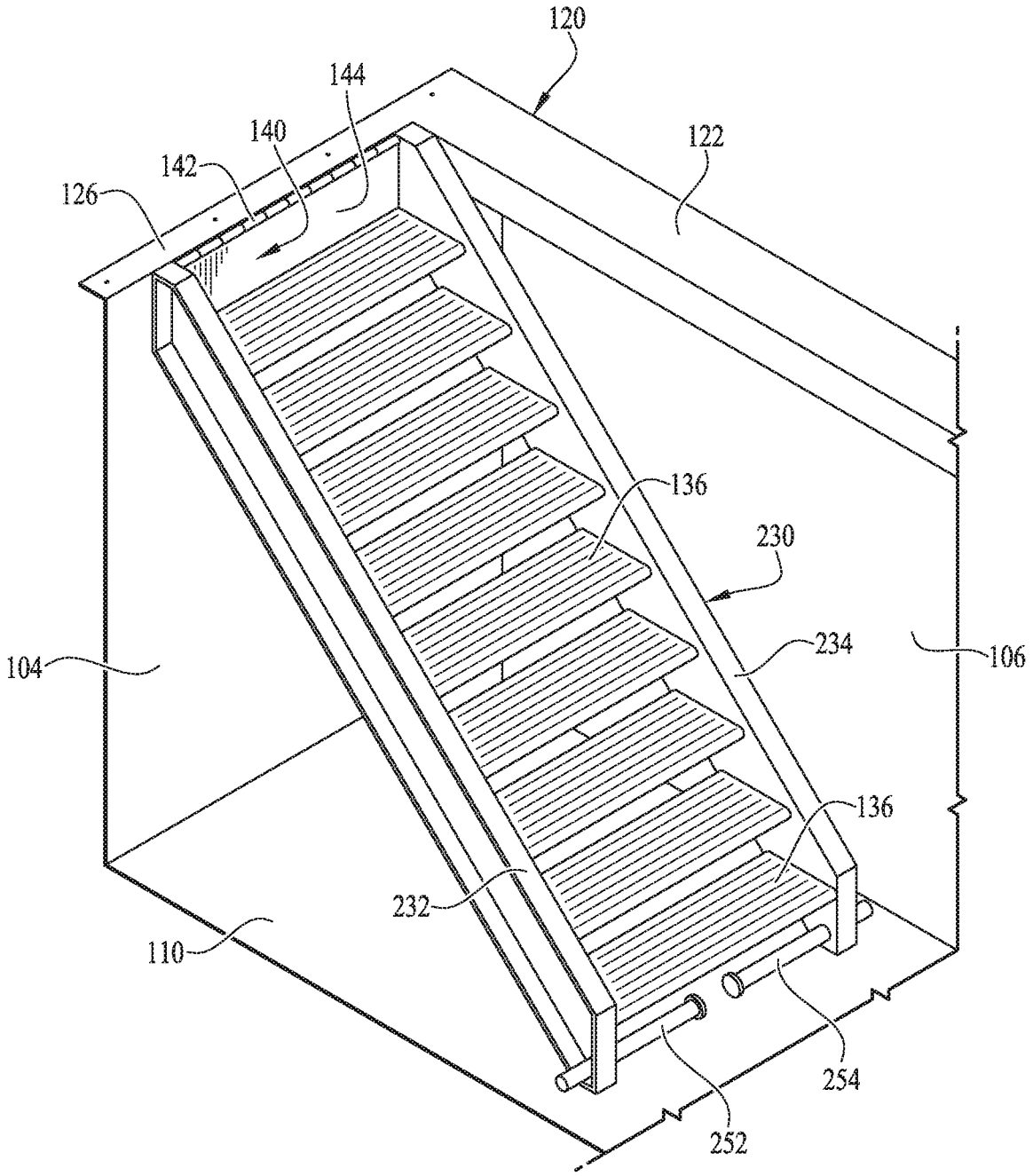
FIG. 6 is a top front isometric view of a portion of a first alternate service pit illustrating a staircase in a lowered position.
Figure 7:
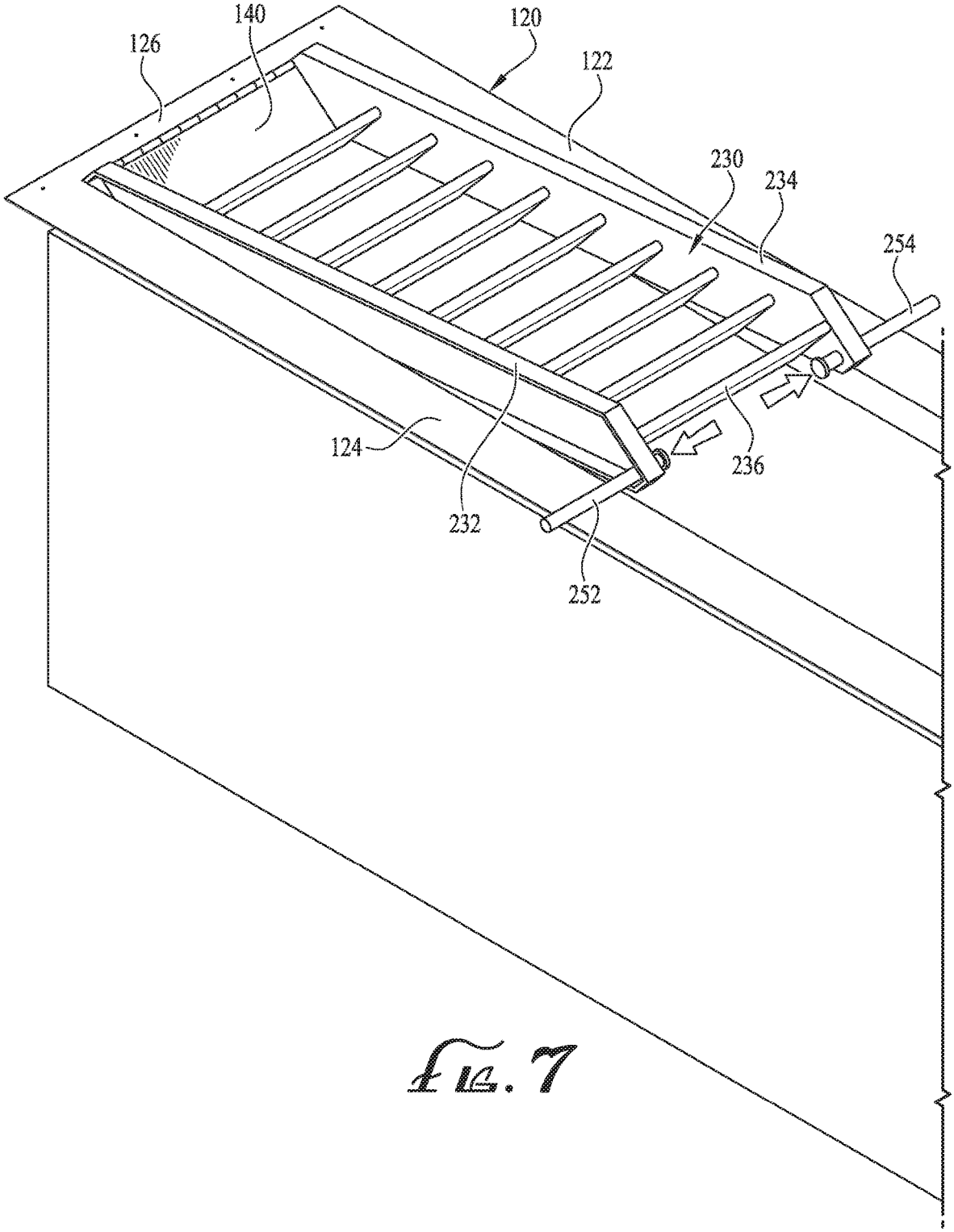
FIG. 7 is a top isometric view of the first alternate service pit of FIG. 6 with the staircase in a raised position.

In some embodiments, the staircase may be provided with a mechanism or means for supporting or holding the staircase 130 in the upper position. FIGS. 6-7 illustrate one embodiment for a staircase 230 having a means for holding the staircase 230 in the raised position, the staircase 230 including retractable bars or tubes 252, 254 disposed below the bottom stair 136. FIG. 6 illustrates the bars 252, 254 in a retracted position while the staircase 230 is in the lowered position down into the service pit. In FIG. 7, the staircase 230 is shown as having been pivoted into the raised position. Once the staircase 230 is pivoted to the raised position, the bars 252, 254 are slid horizontally outwardly (to an outward extended position) through the stair rails 232, 234, thus extending over the rim sections 122, 124 thereby securely supporting/holding the staircase 230 in the raised position. In some embodiments, the bars 252, 254 may slide into openings, slots, or other securing means (not shown) to secure the bars 252, 254 in their extended positions. To lower the staircase 230, the bars 252, 254 are retracted, allowing the user to lower the staircase 230.

In one embodiment, where the bars or tubes 252, 254 comprise hollow tubes, an inner bar or tube of smaller diameter may be disposed inside the tubes 252, 254, the inner bar or tube extending between the left and right rails 232, 234 and providing some additional strength and/or alignment support for the tubes 252, 254. In another embodiment, an outer tube of larger diameter may be disposed outside the bars or tubes 252, 254, the outer tube extending between the left and right rails 232, 234 and providing some additional strength and/or alignment support for the bars or tubes 252, 254.

Figure 8:
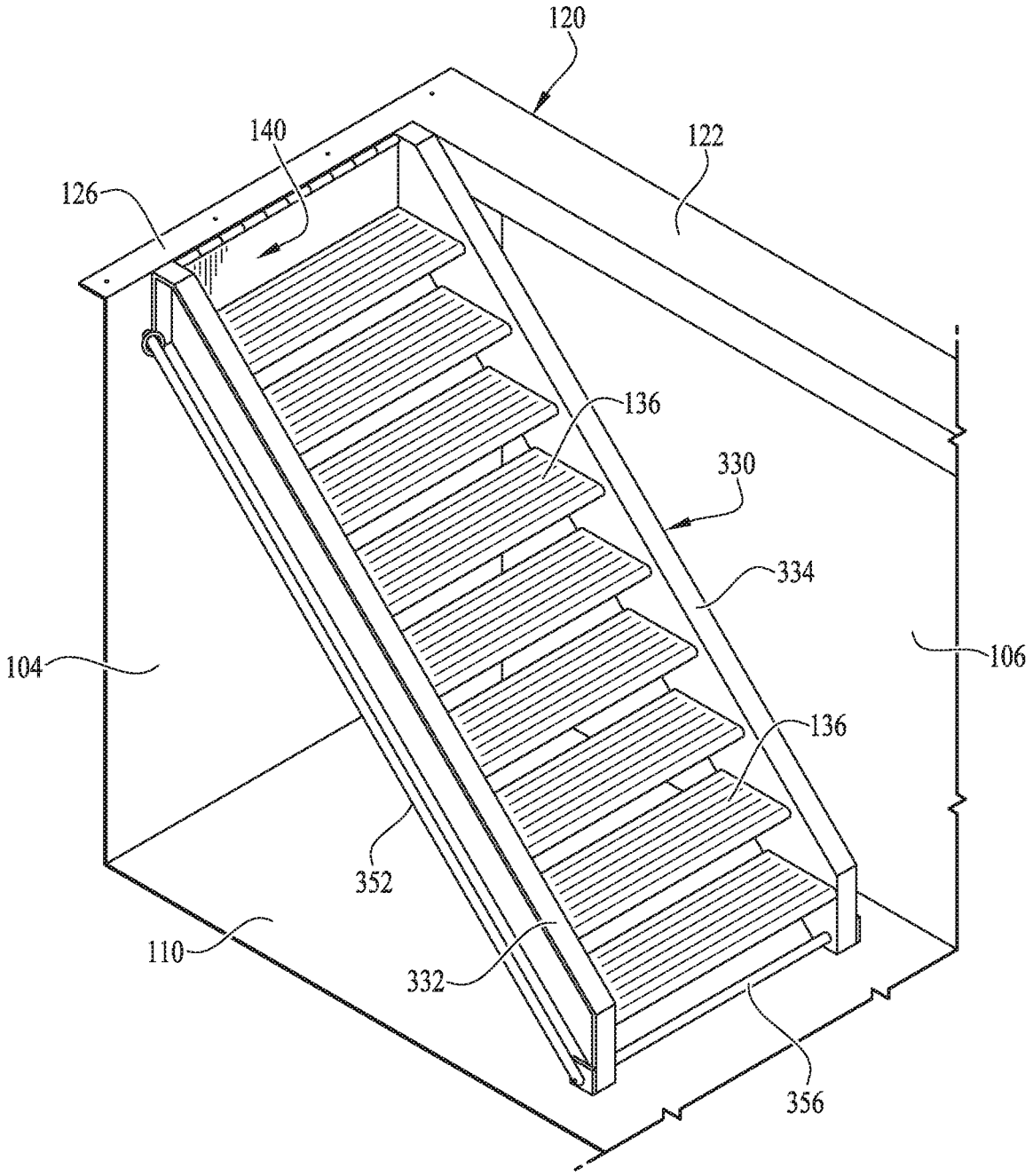
FIG. 8 is a top front isometric view of a portion of a second alternate service pit illustrating a staircase in a lowered position.
Figure 9:
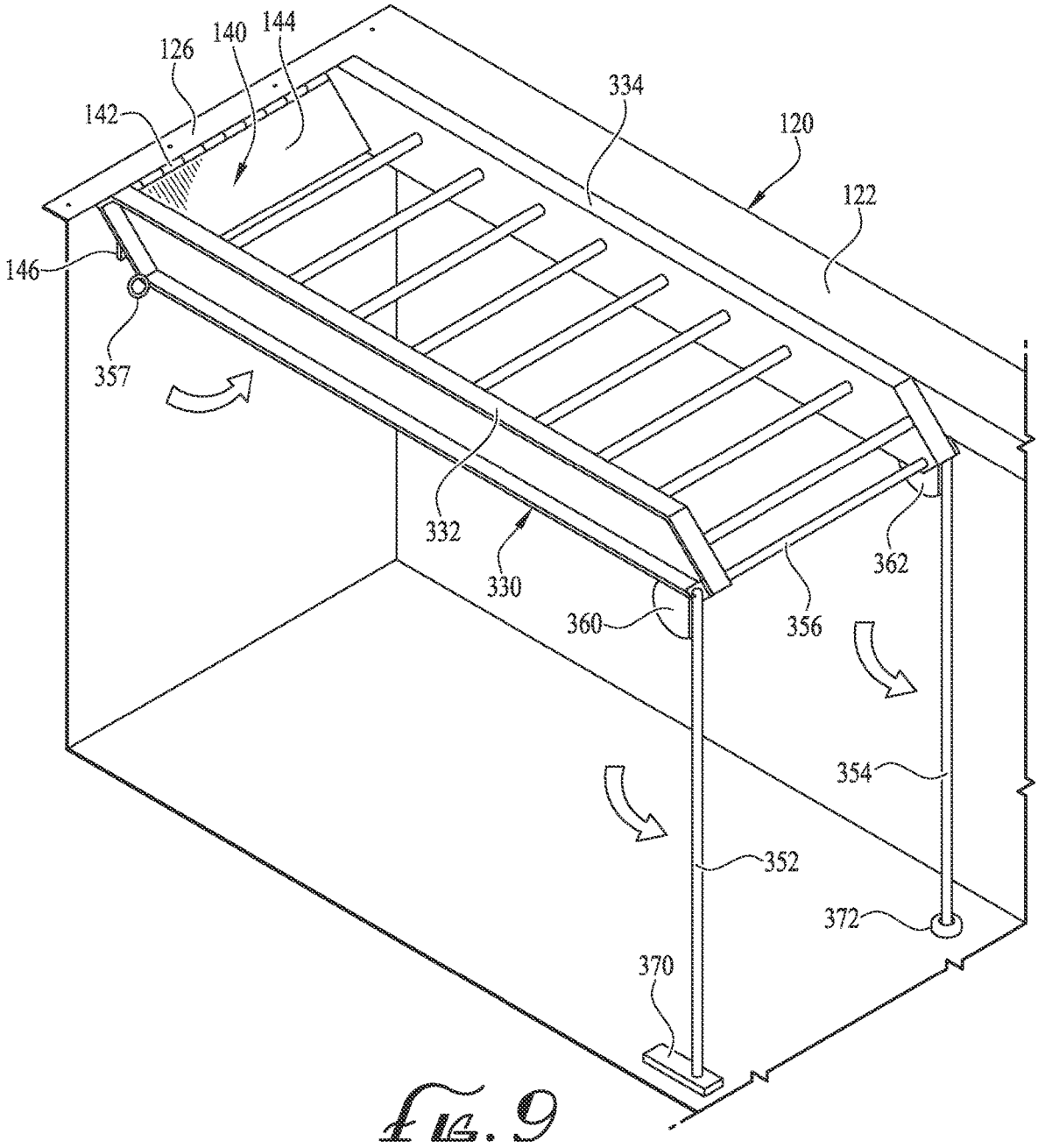
FIG. 9 is a top isometric view of the second alternate service pit of FIG. 8 with the staircase in a raised position.

FIGS. 8-9 illustrate a second embodiment for a staircase 330 having another means for holding the staircase 330 in the upper position, the means comprising retractable/pivotable legs 352, 354 pivotally attached to a lower section of the staircase 330. FIG. 8 illustrates the legs 352 (leg 354 obscured from view) in a retracted position while the staircase 330 is in the lowered position down into the service pit. FIG. 9 illustrates the staircase 330 having been pivoted into the raised position, and once in the raised position, the legs 352, 354 are rotated or pivoted downwardly to an extended position contacting the bottom wall 110, thus securely supporting the staircase 330 in the raised position. A clasp 357 or other suitable holder mechanism may be provided on the rail 332 of the staircase 330 to hold the leg 352 in position when the staircase 330 is lowered. A similar clasp or other suitable holder may also be provided on the rail 334 to hold the leg 354 in place when the staircase 330 is lowered.

To lower the staircase 330 from the raised position to the lowered position, the legs 352, 354 are pivoted back to the retracted position, allowing the user to lower the staircase 330. The ends of the legs 352, 354 may be connected to opposite ends of a cross bar 356 (that extends between the left and right stair rails 332, 334). The cross bar 356 rotates within holes in the rails 332, 334 allowing the legs 352, 354 to pivot between raised and lowered positions.

The system may include a means or mechanism for securing or holding the legs 352, 354 in place when the staircase 330 is in the raised positioned supported by the legs 352, 354. FIG. 9 illustrates four example embodiments for such a means or mechanism for securing or holding the legs 352, 354 in place when the staircase 330 is in the raised positioned supported by the legs 352, 354.

In a first embodiment, the legs 352, 354 are provided with a clasp 360, 362 or other locking element/mechanism disposed between the legs 352, 354 and the side rails 332, 334 to secure the legs 352, 354 in place so as not to rotate out of the holding position in FIG. 9 when the clasp 360, 362 is deployed.

In a second embodiment, each of the legs 352, 354 is provided with a foot 370 shown attached to the bottom of leg 352. In such embodiments, the foot 370 is operative to secure/hold the legs 352, 354 in place so as not to rotate out of the holding position in FIG. 9. In such embodiments, the leg 354 include a similar foot.

In a third embodiment, the bottom wall 110 is provided with a catch mechanism, such as the donut-shaped floor mounted holder 372 (attached to the bottom wall 110). The holder 372 includes a central bore or slot (obscured from view) for accepting insertion of the leg 354 to secure the legs 352, 354 in place so as not to rotate/slide out of the holding position in FIG. 9. In such embodiments, a similar floor-mounted holder would be provided for the leg 352. Alternately, in a fourth embodiment, the floor mounted holders 372 may be replaced by simple holes or indentations in the bottom wall 110 for accepting the ends of the legs 352, 354 and holding them securely in place.

The staircase 130 (or staircase 230 or 330) may be constructed of steel, aluminum or other metal, or other suitable materials.

In one operation, the described system may enable a method of providing access to a bottom floor of a vehicle service pit having a box shaped structure with a bottom floor, front side wall, rear side wall, lateral side walls, and a top opening, the method comprising the steps of: (1) installing a staircase extending from an upper portion of the rear side wall down to the bottom floor; (2) pivotally mounting the staircase to the upper portion of the rear side wall; and (3) providing access into the service pit below the staircase by pivoting the staircase between a first position extending down to the bottom floor and a second position up and out of the service pit.

Figure 10:
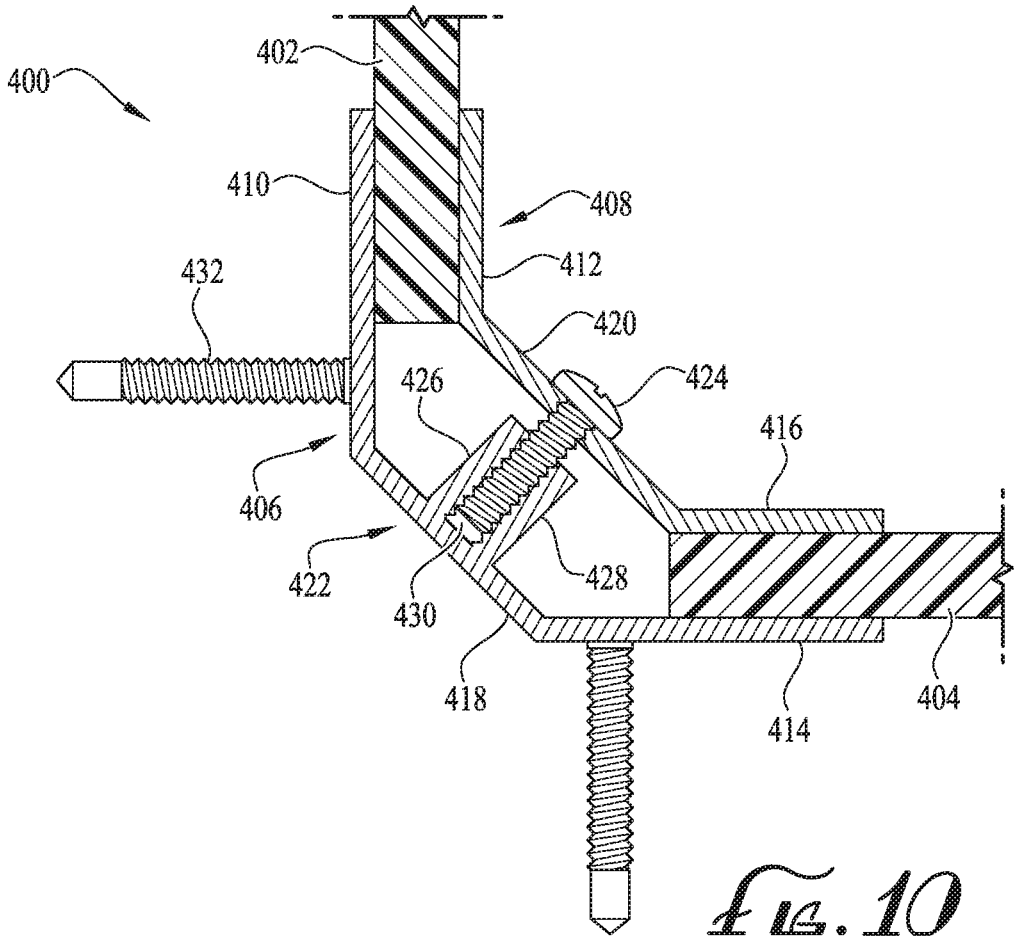
FIGS. 10 and 11 are schematic views of coupling mechanisms for connecting various panels together for the vehicle service pit in accordance with one embodiment.
Figure 11:
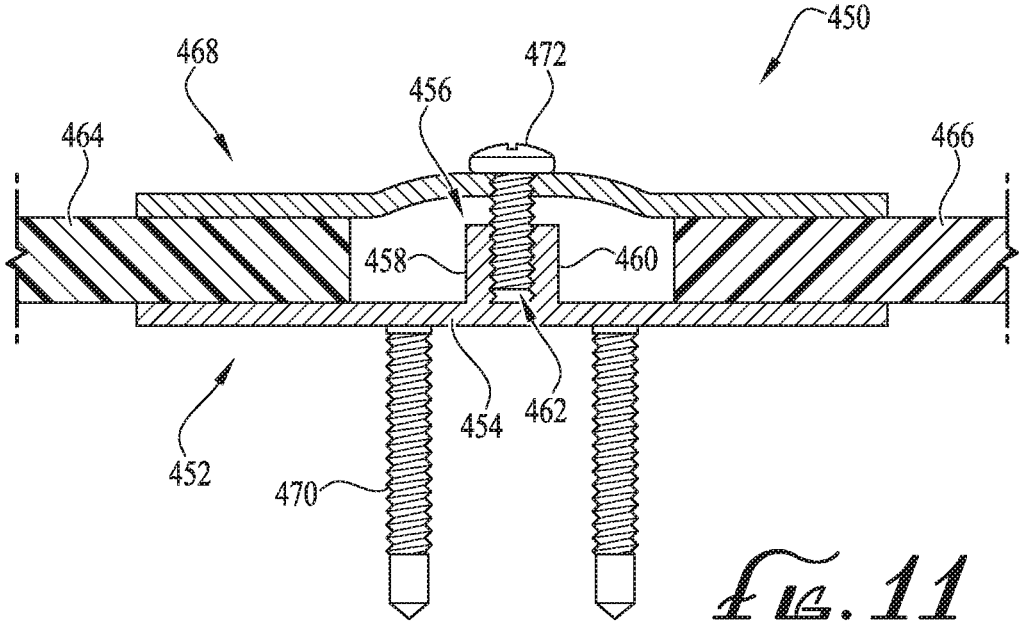

FIGS. 10 and 11 illustrate schematic drawings of coupling mechanisms 400, 450 for connecting panels of the vehicle service pit 100 in accordance with one embodiment. In some embodiments, the walls 102, 104, 106, 108 of the service pit 100 may each be formed by one or more individual panels depending on the overall dimensions of the service pit 100. For example, in one embodiment, side wall 108 may comprise three separate panels coupled together. In such embodiments, the panels may be coupled to one another via coupling mechanisms 400, 450 as further described in detail below.

FIG. 10 illustrates an example embodiment of a first coupling mechanism 400 designed for coupling panels 402, 404 at a corner joint of the vehicle service pit 100. For instance, with reference to FIG. 1, an example corner joint is illustrated as the 45° corner at which the front wall 102 and the side wall 108 meet. In such embodiments, the coupling mechanism 400 may be used to couple the two panels (such as panels 402, 404) forming the respective walls 102, 108 at that corner joint. With reference to FIG. 10, the coupling mechanism 400 includes a first moulding member 406 and a second moulding member 408. Each moulding member 406, 408 includes a first substantially planar segment 410, 412, a second substantially planar segment 414, 416, and a third angled segment 418, 420 extending therebetween to connect the segments together as illustrated.

In some embodiments, the third angled segment 418 of the first moulding member 406 includes a catch 422 designed for receiving a fastener 424. The catch 422 is preferably formed as a unitary component of the first moulding member 406, the catch 422 including a first side wall 426 and a second side wall 428 spaced apart from one another to form a receiving channel 430 therebetween. In a completed assembly, a fastener 424 is received within the channel 430 as further described in detail below. To accommodate the fastener 424, the third angled segment 420 of the second moulding member 408 may include an opening (not shown) for guiding the fastener 424 therethrough and into the channel 430.

In an example assembly method for the vehicle service pit 100, the first moulding member 406 is positioned against the concrete (or concrete liner) at a corner joint in the ground 5 (see FIG. 2). Thereafter, fasteners 432 are inserted through the first and second segments 410, 414 of the first moulding member 406 to secure the first moulding member 406 to the concrete (or concrete liner) in position at the corner joint. Thereafter, a first panel 402 (which may ultimately form side wall 108) is positioned against an end region of the first segment 410, and a second panel 404 (which may ultimately form front wall 102) is positioned against an opposite end region of the second segment 414. As illustrated in FIG. 10, the panels 402, 404 are spaced apart from one another at the corner joint. In some embodiments, this spacing may be helpful when the panels are made of acrylic or other similar materials to accommodate for potential expansion and contraction of the panels over time. Once the panels 402, 404 are properly aligned as desired, the second moulding member 408 is arranged on top of the panels 402, 404 to sandwich the panels 402, 404 between the moulding members 406, 408. In this configuration, the first segment 412 of the second moulding member 408 rests against the first panel 402, and the second segment 416 of the second moulding member 408 rests against the second panel 404. Finally, a fastener 424 is inserted through the opening on the third angled segment 420 of the second moulding member 408 and into the channel 430 to complete the assembly and securely retain the panels 402, 404.

As described previously, the coupling mechanism 400 may be used to attach all panels at the various corner joints, including corner joints between adjacent upright vertical walls, and corner joints formed along the bottom of the vehicle service pit 100. In some embodiments, depending on the length of the side walls 106, 108 (or the front and rear walls 102, 104), the vehicle service pit 100 may further include a second coupling mechanism 450 designed for coupling vertical panels of a single wall together. With reference to FIG. 11, the following provides additional details regarding the second coupling mechanism 450.

With reference to FIG. 11, the second coupling mechanism 450 includes a first moulding member 452 and a second moulding member 468 offset from one another. The first moulding member 452 includes a substantially planar base 454 with a catch 456 designed for receiving a fastener 458. The catch 456 is preferably formed as a unitary component of the first moulding member 452, the catch 456 including a first side wall 458 and a second side wall 460 spaced apart from one another to form a receiving channel 462 therebetween.

In an example assembly method, the first moulding member 452 is positioned against the concrete (or concrete liner) at a position between the respective vertical panels 464, 466. Thereafter, fasteners 470 are inserted through the base 454 of the first moulding member 452 to secure the first moulding member 452 to the concrete (or concrete liner) in position. Thereafter, a first panel 464 (which may ultimately form a first segment of the side wall 108) is positioned against an end region of the base 454, and a second panel 466 (which may ultimately form a second segment of the side wall 108) is positioned against an opposite end region of the base 454 such that the panels 464, 466 are offset from one another. Once the panels 464, 466 are properly aligned as desired, a second moulding member 468 is arranged on top of the panels 464, 466 to sandwich the panels 464, 466 between the moulding members 452, 468. Finally, a fastener 472 is inserted through the opening (not shown) on the second moulding member 468 and into the channel 462 to complete the assembly and securely retain the panels 464, 466. The coupling mechanism 450 may be used for coupling any vertical panels at non-corner joints.

Although the description above contains much specificity, these details should not be construed as limiting the scope of the invention, but as merely providing illustrations of some embodiments of the invention. It should be understood that subject matter disclosed in one portion herein can be combined with the subject matter of one or more of other portions herein as long as such combinations are not mutually exclusive or inoperable. The terms and descriptions used above are set forth by way of illustration only and are not meant as limitations. It will be obvious to those having skill in the art that many changes may be made to the details of the above-described embodiments without departing from the underlying principles of the invention. Those having skill in the art should understand that other embodiments than those described herein are possible.

The invention claimed is:

1. A vehicle service pit comprising:

a structure having a top opening and a bottom floor, the structure further including a front side wall and an opposite rear side wall, a first side wall and an opposite second side wall, and a cavity formed between the front side wall, the rear side wall, the first side wall, and the second side wall;

a staircase including a first rail, a second rail, and a plurality of stairs extending between the first rail and the second rail;

a first leg and a second leg each pivotally attached to the staircase; and a hinge assembly pivotally mounting the staircase to the rear side wall of the structure, the hinge assembly operable to accommodate movement of the staircase from a raised position, whereat the staircase is offset from the bottom floor of the structure, to a lowered position, whereat the staircase extends from the rear side wall into the cavity of the structure and contacts the bottom floor, the staircase providing a pathway along the stairs from the top opening of the structure to the bottom floor while in the lowered position, wherein the first leg and the second leg of the staircase are each pivotable between (1) a retracted position while the staircase is in the lowered position against the bottom floor of the structure, and (2) an extended position while the staircase is in the raised position, the first and second legs extending downwardly into the cavity and contacting the bottom floor of the structure to support the staircase in the raised position.

2. The vehicle service pit of claim 1, further comprising means for securing the first and second legs in position when the staircase is in the raised position and supported by the first and second legs.

3. The vehicle service pit of claim 1, wherein the first leg and the second leg each includes a foot operative for holding the respective leg in place against the bottom floor of the structure when the staircase is in the raised position and supported by the first and second legs.

4. The vehicle service pit of claim 1, wherein first leg and the second leg each includes a clasp or locking element for holding the respective leg in place when the staircase is in the raised position supported by the first and second legs.

5. The vehicle service pit of claim 1, wherein the first leg is coupled to the first rail and the second leg is coupled to the second rail.

6. The vehicle service pit of claim 5, wherein the first rail and the second rail each includes a clasp for securing and receiving the first and second legs, respectively, when the staircase is in the lowered position.

7. The vehicle service pit of claim 1, further comprising means for supporting the staircase in the raised position.

8. The vehicle service pit of claim 1, further comprising a coupling mechanism positioned between and coupling the front wall and the first side wall.

9. The vehicle service pit of claim 8, wherein the coupling mechanism includes a first moulding member having a first segment, a second segment, and a third angled segment extending between the first and second segments.

10. The vehicle service pit of claim 9, wherein the third angled segment further includes a catch for receiving a fastener therein.

11. The vehicle service pit of claim 8, wherein the front wall and the first side wall are separated from one another within the coupling mechanism, and wherein the coupling mechanism provides a seal between the front wall and the first side wall.

12. The vehicle service pit of claim 1, wherein the first side wall includes a first panel and a second panel coupled to one another via a coupling mechanism.

13. The vehicle service pit of claim 12, wherein the first panel and the second panel are offset from one another within the coupling mechanism, and wherein the coupling mechanism provides a seal between the first panel and the second panel.

14. The vehicle service pit of claim 1, further comprising a crossbar coupled to the staircase and to each of the first leg and the second leg, wherein the crossbar is operable to pivot the first leg and the second leg between the retracted position when the staircase is in the lowered position and to the extended position when the staircase is in the raised position.

15. The vehicle service pit of claim 14, wherein the first rail and the second rail of the staircase each includes an opening through which the crossbar extends, wherein the crossbar is rotatable within the opening to pivot the first leg and the second leg between the retracted position and the extended position.

* * * * *